United States Patent [19]

Nunley et al.

[11] Patent Number: 4,707,961

[45] Date of Patent: Nov. 24, 1987

[54] COMPOSITE ROOF/ROOF DECK ASSEMBLY WITH POLYMERIC MEMBRANE

[75] Inventors: C. Lynn Nunley, Dallas; Joe W. Tomaselli, Plano, both of Tex.

[73] Assignee: Loadmaster Systems, Inc., Dallas, Tex.

[21] Appl. No.: 788,796

[22] Filed: Oct. 18, 1985

Related U.S. Application Data

[63] Continuation-in-part of Ser. No. 757,122, Jul. 19, 1985, which is a continuation of Ser. No. 330,335, Dec. 14, 1981, abandoned, which is a continuation of Ser. No. 603,892, Aug. 11, 1975, abandoned, which is a continuation-in-part of Ser. No. 231,642, Mar. 3, 1972, abandoned.

[51] Int. Cl.[4] ..... E04B 5/00; E04C 1/00; B32B 7/04

[52] U.S. Cl. ..... 52/408; 52/309.5; 52/309.8; 52/309.12; 52/410; 52/741; 156/71; 428/182; 428/309.9; 428/317.7; 428/318.4; 428/319.1

[58] Field of Search ..... 156/45, 71; 428/309.9, 428/316.6, 317.1, 317.7, 318.4, 319.1; 52/309.5, 309.8, 309.12, 410, 741

[56] References Cited

U.S. PATENT DOCUMENTS

| | | | |
|---|---|---|---|
| 3,362,119 | 1/1968 | Murphy | 52/309.8 |
| 3,466,827 | 9/1969 | Clem | 52/408 |
| 3,483,664 | 12/1969 | Funk et al. | 428/317.1 |
| 3,763,614 | 10/1973 | Hyde et al. | 52/408 |
| 3,971,184 | 7/1976 | Van Wagoner | 52/408 |
| 4,063,395 | 12/1977 | Stewart et al. | 52/309.5 |
| 4,071,993 | 2/1978 | Stewart et al. | 52/309.5 |
| 4,441,295 | 4/1984 | Kelly | 52/408 |
| 4,450,663 | 5/1984 | Watkins | 52/309.8 |
| 4,601,151 | 7/1986 | Nunley et al. | 52/410 |

OTHER PUBLICATIONS

Loadmaster Roof Deck Systems Publication (1981), Dallas, Tex., 12 pages.

*Primary Examiner*—William J. Van Balen
*Attorney, Agent, or Firm*—Crutsinger & Booth

[57] ABSTRACT

A composite roof/roof deck assembly and method of installation wherein a roof covering of polymeric sheet material is adhered to an underlying mineral board roof substrate with a water based polymeric adhesive.

19 Claims, 2 Drawing Figures

COMPOSITE ROOF/ROOF DECK ASSEMBLY WITH POLYMERIC MEMBRANE

CROSS REFERENCE TO RELATED APPLICATIONS

This application is a continuation-in-part of application Ser. No. 757,122, filed July 19, 1985, which is in turn a continuation of application Ser. No. 330,335, filed Dec. 14, 1981, now abandoned, which is in turn a continuation of application Ser. No. 603,892 filed Aug. 11, 1975, now abandoned, which is in turn a continuation-in-part of application Ser. No. 231,642, filed Mar. 3, 1972, now abandoned. This and the prior applications are all commonly assigned.

TECHNICAL FIELD

This invention relates to roofing systems, and more particularly, to a composite roof/roof deck assembly. One aspect of the invention relates to a composite roof/roof deck assembly comprising a roof covering of polymeric sheet material which functions as a moisture barrier when installed over a conventional mineral board roof decking material. Another aspect of the invention relates to a composite roof deck assembly comprising a water based, polymeric adhesive that is specially adapted for use in joining a polymeric roof covering to underlying mineral board in a roof deck. A further aspect of the invention relates to a method for installing a polymeric roof membrane as part of a composite roof/roof deck assembly.

BACKGROUND ART

The polymeric membrane and polymeric adhesive of the invention are specially adapted for use with composite roof/roof deck assemblies comprising corrugated steel roof deck sections overlaid with optional insulation material and mineral board.

Notwithstanding the many advantages of such composite roof/roof deck assemblies, individuals using more conventional roofing/roof deck systems have encountered problems that can be avoided through the use of the invention disclosed herein. One problem relates to water that passes downward through cracks from the roof surface to the underlying roof deck material. The water passageways may be attributable to mistakes made by workers in applying the roof cover, or can be the result of long term weathering or wear on the roof surface, building movement, condensation, wind uplift or the like. Water leakage is a matter of particular concern with roofs having little or no slope, upon which water, ice or snow can accumulate. Prolonged contact between significant amounts of water and the underlying roof membrane and, in turn, roof deck material can lead to their softening, thereby detrimentally affecting the strength and integrity of the roof deck/roofing system.

Problems have also been encountered with the leakage of asphalt, pitch or tar downward through cracks, crevices, or other imperfections in the conventional roof/roof deck assemblies. Still another problem relates to air leaks through the roof deck that may contribute to heat or air conditioning loss from the building interior as well as wind uplift damage. This circumstance is frequently seen where ballasted and mechanically anchored polymeric roof membranes are used.

U.S. Pat. No. 4,441,295 to Kelly discloses a roofing installation wherein an elastomeric membrane is bonded to a rigid, membrane support board by means of a suitable bonding contact adhesive applied in a specific pattern. However, because elastomeric sheet material is typically coated with talc to prevent sticking during storage and shipment, problems have been encountered in using solvent based contact adhesives unless the talc is first cleaned from the elastomeric surface to be bonded. Other problems have arisen with solvent based contact adhesives because of their fast drying times and the resultant inability of installers to reposition sheets once they contact the underlying roof deck material.

To effectively deal with these problems, a means and method are therefore needed for easily and effectively adhering the roof membrane to the underlying roof deck materials of a composite roof deck/roofing assembly.

SUMMARY OF THE INVENTION

According to the present invention, a composite roof/roof deck assembly is provided that preferably comprises an outward facing polymeric roof covering layer, a mineral board substrate installed over a corrugated steel roof deck, and a polymeric adhesive disposed between the top surface of the mineral board layer and the polymeric roof covering. According to a preferred embodiment of the invention, the polymeric membrane is joined to the underlying mineral board by a water based, polymeric adhesive.

According to another embodiment of the invention, a composite roof/roof deck assembly is provided comprising corrugated steel, optional insulation, mineral board, water based polymeric adhesive and a polymeric membrane roof covering material in successive layers. The mineral board is preferably joined to the underlying corrugated steel by appropriate fasteners, and an additional layer of insulating material can optionally be inserted between the mineral board and corrugated steel deck.

According to another embodiment of the invention, a composite roof/roof deck assembly is provided that preferably comprises a polymeric roof covering layer that is substantially continuous and substantially coextensive with the underlying rigid substrate layer. A preferred material for use as the polymeric layer is vulcanized ethylene propylene diene terpolymer (EPDM) although other polymeric materials can be similarly useful. The polymeric layer is desirably joined to the substrate layer by a water based, polymeric adhesive.

According to another embodiment of the invention, a composite roof/roof deck assembly is provided that comprises a polymeric sheet material adhered to underlying mineral board by a substantially coextensive coating of water based, polymeric adhesive comprising methanol, deionized water, acrylic acid polymer, sodium hydroxide, polyvinyl alcohol/vinyl acetate, polyisoprene latex and aluminum silicate.

According to another embodiment of the invention, a method is provided for constructing a moisture-resistant, composite roof/roof deck assembly comprising the steps of installing a substantially rigid substrate layer comprising mineral board faced with slightly permeable, water-resistant paper; distributing a substantially continuous coating of water based, polymeric adhesive over the upward facing surface of the substrate layer; spreading a sheet of moisture-resistant polymeric material into and above the water-based polymeric adhesive; applying downward pressure across the upward facing surface of the polymeric sheet to enhance facing contact between the upward facing surface of the substrate layer and the downward facing surface of the polymeric sheet with the water based, polymeric adhesive therebetween; and allowing the water based, polymeric adhesive to dry, thereby adhering the polymeric sheet to the upward facing surface of the underlying substrate.

BRIEF DESCRIPTION OF THE DRAWINGS

The invention is further described and explained in relation to the following drawings in which.

Like numbers are used to indicate like parts in both figures of the drawings.

DESCRIPTION OF THE PREFERRED EMBODIMENT

Figure 1:
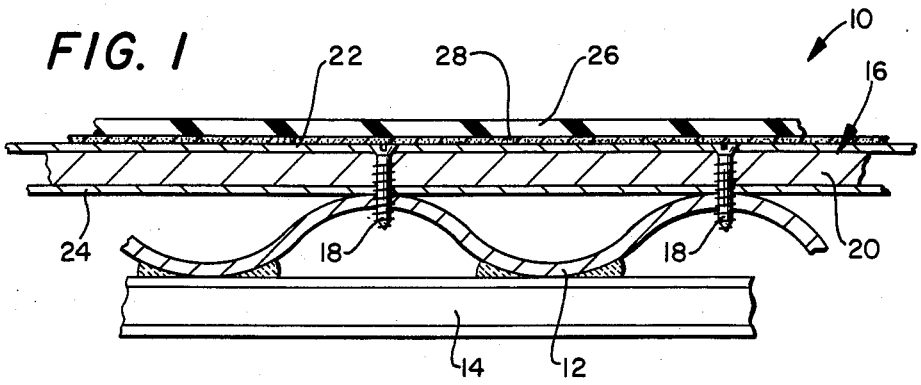
FIG. 1 is a broken-away, sectional elevation view of a preferred composite roof/roof deck assembly of the invention.

Referring to FIG. 1, composite roof/roof deck assembly 10 preferably comprises corrugated steel deck sheet 12 supported by purlin 14. Corrugated steel roof deck sheets 12 are attached to the supporting purlins 14 by satisfactory attachment means such as plug welds, through weld washers, self-tapping self-drilling hexhead screws or the like. Mineral board 16 is joined to corrugated steel deck sections 12 by fasteners 18, which desirably penetrate corrugated steel deck sections 12 at the upward extending crest of the corrugations and are countersunk so that their heads are substantially coplanar with the upward extending surface of mineral board 16.

Mineral board 16 further comprises a relatively high density, substantially rigid core of gypsum 20 faced by upper and lower layers 22, 24 of slightly permeable, water-resistant paper. High density mineral board 16 preferably has tongues and grooves formed on opposite longitudinal edges thereof to provide a substantially continuous interlocking roof deck. Although the method of attachment shown in FIG. 1 is satisfactory for use with the subject roof/roof deck assembly, other methods of attachment can also be used within the scope of the invention. Generally speaking, mineral board 16 is mechanically anchored to a symmetrically or non-symmetrically corrugated section of relatively thin material with an anchorage pattern of sufficient spacing and frequency to stabilize the corrugations of the corrugated deck section from lateral or vertical distortion under loading, thus forcing the corrugated section to maintain its shape. Upper and lower layers 22, 24 of paper are chemically bonded to gypsum core 20 of mineral board 16.

In accordance with the present invention, a composite roof/roof deck assembly 10 further comprises a substantially continuous sheet or membrane of polymeric material 26 which is joined to paper layer 22 of mineral board 16 by adhesive layer 28. Paper layer 22 is preferably slightly water-permeable, but is adapted to resist initial penetration of large amounts of water. Thus, paper layer 22 will prevent mineral board 16 from being damaged by rainfall prior to overlaying it with polymeric material 26, but will permit limited and controlled permeation by water within adhesive layer 28 to enhance bonding between mineral board 16 and polymeric membrane 26.

Polymeric membrane 26 preferably comprises a vulcanized synthetic rubber that exhibits excellent resistance to weathering under varying climatic conditions. A preferred material for use as the polymeric membrane is vulcanized ethylene propylene diene terpolymer (EPDM) although other elastomeric polymer materials can be similarly useful. Ethylene propylene diene terpolymer is one of a class of elastomers designated by ASTM as "M" class rubbers. "M" class rubbers have a chemically saturated polymer chain of the polymethylene type. EDPMs are ethylene, propylene, and a small percentage of diene which provides unsaturation in side chains pendant from the unsaturated "back bone."

According to a particularly preferred embodiment of the invention, polymeric membrane 26 comprises a vulcanized EPDM terpolymer calendered into a two-ply flat sheet about 0.045 inches thick and weighing approximately 0.30 pounds per square foot. Although the length, width and thickness of the polymeric sheet are not critical, the sheets are advantageously small enough to be manageable but large enough to reduce the number of seams required to cover the roof deck. Satisfactory results have been achieved using rolls about 52 inches wide by 100 feet long or blankets either 10 feet or 20 feet wide by 100 feet long. Physical properties for a preferred EPDM terpolymer for use as a polymeric membrane 26 of the invention are set forth in Table I below:

TABLE I

| | |
|---|---|
| Thickness | .045 in. ± .003 |
| Specific Gravity ASTM-D-297-68 | 1.34 ± .03 |
| Tensile Strength ASTM-D-412 | 1400 psi minimum |
| Ultimate Elongation ASTM-D-412 | 300% minimum |
| Tear Resistance ASTM-D-624 Die C | 125 lbs./min. minimum |
| Shore A Hardness ASTM-D-2240-68 | 60 ± 10 |
| Ozone Resistance ASTM-D-1149 50 PPHM under 20% Elongation at 100° F. for 30 days | No Cracks in 30 days |
| Heat Resistance Tensile Strength ASTM-D-573 250° F. for 7 days | 1050 psi minimum |
| Heat Resistance Ultimate Elongation ASTM-D-573 250° F. for 7 days | 225% minimum |
| Water Absorption (Volume) ASTM-D-471 158° F. for 48 hrs. | 5.0% maximum |
| Low Temperature Brittleness ASTM-DS-2137 at 60° F. | no adverse effect |
| Service Temperature Range | −70° F. to 300° F. |
| Dimensional Stability Shrinkage MIL-P-12420 212° F. for 28 days | 2% maximum length & width |
| Water Vapor Transmission ASTM-E-96-66 Method B + BW | .004 perm-inches maximum |

The abutting edges of adjacent sheets of polymeric membrane 26 are preferably sealed by overlaying them with either four or six-inch wide batten strips of unvulcanized EPDM terpolymer bonded to a partially cured polymeric compound (not shown). EPDM batten strips can also be used to strip in and seal exposed metal flanges such as gravel guard, expansion joint shield, pitch pans, and the like. Prior to installation of the batten strips, that portion of the upward facing surface of polymeric membrane 26 to be covered by the batten strips is primed with a polymeric bonding agent to enhance the compound-to-rubber bond between the batten strips and the underlying EPDM sheets. Such compound-to-rubber bonding agents are commercially available and well known in the art.

Adhesive layer 28 preferably comprises a water based, polymeric adhesive that, when cured, has excellent adhesive and elongation properties. The function of adhesive 28 is to permanently join the downward facing surface of polymeric membrane 26 to upward facing paper layer 22 of mineral board 16. The use of a suitable water based, polymeric adhesive is critical to the composite roof/roof deck assembly and method of the invention.

In other roof deck systems, people have previously attempted to overlay roof substrate materials using solvent-based contact adhesives. The use of such adhesives has proved to be unsatisfactory because their adhesive characteristics strictly preclude the repositioning and smoothing that is needed to align edges of adjacent polymeric sheets 26 and eliminate air pockets and fishmouths that otherwise prevent facing contact and substantially uniform adhesion between polymeric sheet 26 and mineral board substrate 16.

A preferred adhesive for use as adhesive layer 28 of composite roof/roof deck assembly 10 comprises about 50 weight percent polisoprene latex, about 25 weight percent polyvinyl alcohol/vinyl acetate, about 15 weight percent deionized water, about 8 weight percent aluminum silicate, and less than about 1 weight percent each of methanol, acrylic acid polymer and sodium hydroxide.

Adhesive layer 28 is preferably applied in an even coat at a rate of approximately one gallon per 100 square feet to the exposed upward facing surface of mineral board 16. Since the water based, polymeric adhesive of the invention is not a contact adhesive, polymeric membrane 26 can be moved and adjusted as required before adhesive layer 28 begins to take its initial set.

Once the upward facing surface of mineral board 16 is covered by adhesive layer 28, polymeric sheet 26 is desirably spread over adhesive layer 28 so as to provide a substantially continuous and coextensive polymeric covering over the upward facing surface of mineral board 16. When spreading polymeric sheets 26 over mineral board 16, care should be taken to avoid positioning a seam between adjacent polymeric sheets 26 over a joint between interlocking panels of mineral board 16, thereby further reducing any possibility of leakage through composite roof/roof deck assembly 10. Care should also be taken to traverse polymeric sheet 26 with apparatus adapted to exert a downward pressure against polymeric membrane 26 and underlying adhesive layer 28 and mineral board 16 so as to promote sealing engagement therebetween.

According to a particularly preferred method for installing polymeric membrane 26 over mineral board 16 in composite roof/roof deck assembly 10 of the invention, the exposed deck formed by the upward facing surface of mineral board 16 is inspected and all improperly positioned fasteners 18 are corrected or removed. Trash and debris are removed from the surface prior to applying adhesive layer 28. The water base, polymeric adhesive is then applied at the rate of approximately one gallon per 100 square feet. Polymeric membrane 26 is laid into and over the adhesive, with adjacent sheets substantially butted into adjacent and contacting relation. Care should be taken to insure that no fishmouths occur during installation of the polymeric membrane. This is desirably accomplished by "brooming" the polymeric sheet into adhesive layer 28. Once adhesive layer 28 has set, permanently joining polymeric membrane 26 to mineral board 16, composite roof/roof deck assembly 10 is completed.

Figure 2:
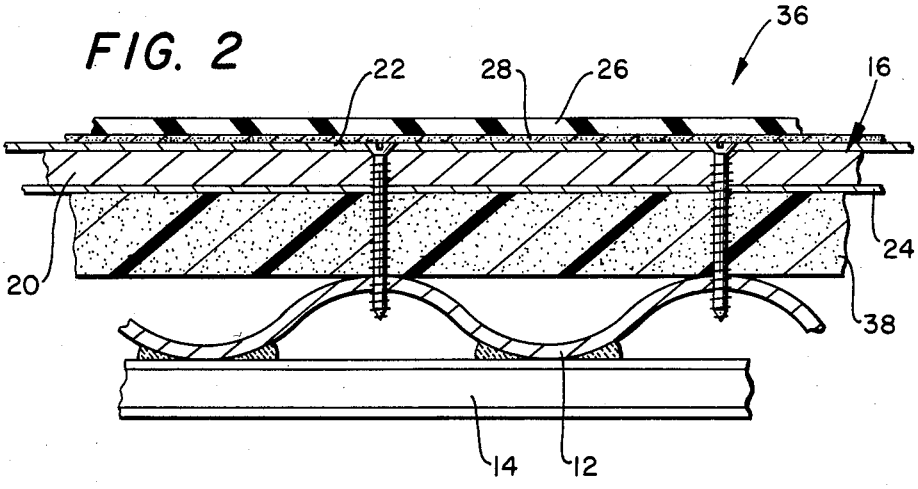
FIG. 2 is a broken-away, sectional elevation view of another preferred composite roof/roof deck assembly of the invention that is similar to the structure shown in FIG. 1, but contains an additional layer of insulating material disposed between the corrugated steel deck and the mineral board layer.

Referring to FIG. 2, an alternative composite roof/roof deck assembly 36 is shown that is substantially identical to that of FIG. 1, but with the addition of an optional insulation layer 38. Insulation layer 38 preferably comprises sheets of expanded polystyrene. However, it should be appreciated that other insulation materials such as polyurethane, polyisocyanurate, phenolic and the like may be employed in combination with or in lieu of polystyrene.

The composite roof/roof deck assemblies of the invention are not recommended for use where interior temperatures are maintained in excess of about 200° F. or for use in structures where the relative humidity is maintained in excess of 70%.

Good design practice includes the need for all roof decks to be designed for positive drainage, and it is recommended that all corrugated steel sections be installed with the corrugations positioned parallel to the roof slope.

Adhesive layer 28 should not be applied when the ambient air, roofing substrate temperature is below about 35° F. Furthermore, the water based, polymeric adhesive employed in adhesive layer 28 should not be exposed to conditions where ambient air temperatures can be expected to drop below about 33° F. prior to application. The water base, polymeric adhesive is preferably stored in environments that are well ventilated, dry and where the ambient air temperature is at least about 55° F. Where it is anticipated that the water based adhesive employed in the composite roof/roof deck assembly of the invention will be either stored or installed under marginal temperature conditions, up to about 5% by volume of ethylene glycol can be mixed with the adhesive to lower its freeze point.

While the composite roof/roof deck assembly of the invention has been described in relation to the preferred embodiments shown in FIGS. 1 and 2, it is understood that the polymeric membrane and water based adhesive layer of the invention are similarly applicable to this or other roof deck systems employing high density, paper-faced mineral board, and it is understood that such alterations and modifications fall within the scope of the appended claims.

What is claimed is:

1. A composite roof/roof deck assembly comprising a substantially rigid substrate layer; a substantially continuous polymeric sheet disposed over said substrate layer;

and a water based, polymeric adhesive comprising: methanol, dionized water, acrylic acid polymer, sodium hydroxide, polyvinyl alcohol/vinyl acetate, polyisoprene latex, and aluminum silicate disposed between said substrate layer and said polymeric sheet to join said substrate layer to said sheet.

2. The composite roof/roof deck assembly of claim 1 wherein said substrate layer is mineral board comprising a gypsum core faced with paper.

3. The composite roof/roof deck assembly of claim 1 wherein said polymeric sheet comprises rubber sheet material.

4. The composite roof/roof deck assembly of claim 3 wherein said rubber sheet material comprises ethylene propylene diene terpolymer.

5. The composite roof/roof deck assembly of claim 4 wherein said ethylene propylene diene terpolymer is vulcanized.

6. The composite roof/roof deck assembly of claim 4 wherein said ethylene propylene diene terpolymer sheet is about 0.045 inches thick and weighs about 0.30 pounds per square foot.

7. The composite roof/roof deck assembly of claim 1 wherein said water based, polymeric adhesive further comprises about 50 weight percent polyisoprene latex, about 25 weight percent polyvinyl alcohol/vinyl acetate, about 15 weight percent deionized water, about 8 weight percent aluminum silicate, and less than about one weight percent each of methanol, acrylic acid polymer and sodium hydroxide.

8. A composite roof/roof deck assembly comprising corrugated steel, mineral board overlying said corrugated steel and connected thereto by fasteners extending through said mineral board and said corrugated steel, water based polymeric adhesive overlying said mineral board, and a polymeric sheet overlying said water based polymeric adhesive.

9. The composite roof/roof deck assembly of claim 8, further comprising a layer of insulation sheet material disposed between said corrugated steel and said mineral board.

10. The composite roof/roof deck assembly of claim 8 wherein said mineral board comprises a core further comprising gypsum, said core being faced on at least the major surfaces thereof with paper.

11. The composite roof/roof deck assembly of claim 8 wherein said polymeric sheet further comprises an elastomer.

12. The composite roof/roof deck assembly of claim 11 wherein said elastomer is rubber.

13. The composite roof/roof deck assembly of claim 12 wherein said rubber is ethylene propylene diene terpolymer.

14. The composite roof/roof deck assembly of claim 12 wherein said rubber is vulcanized.

15. The composite roof/roof deck assembly of claim 12 wherein said sheet is about 0.045 inches thick and weighs about 0.30 pounds per square foot.

16. The composite roof/roof deck assembly of claim 8 wherein said water based polymeric adhesive further comprises methanol, deionized water, acrylic acid polymer, sodium hydroxide, polyvinyl alcohol/vinyl acetate, polyisoprene latex, and aluminum silicate.

17. The composite roof/roof deck assembly of claim 16 wherein said water based, polymeric adhesive further comprises about 50 weight percent polyisoprene latex, about 25 weight percent polyvinyl alcohol/vinyl acetate, about 15 weight percent deionized water, about 8 weight percent aluminum silicate, and less than about one weight percent each of methanol, acrylic acid polymer and sodium hydroxide.

18. A method for constructing a composite roof/roof deck assembly comprising the steps of installing a substantially rigid substrate layer comprising mineral board face with paper on at least its upward and downward facing major surfaces; distributing a substantially continuous coating of water based, polymeric adhesive comprising methanol, deionized water, acrylic acid polymer, sodium hydroxide, polyvinyl alcohol/vinyul acetate, polyisoprene latex, and aluminum silicate over the upward facing surface of said substrate layer; spreading a rubber sheet of ethylene propylene diene terpolymer over the water-based polymeric adhesive; applying downward pressure across the upward facing surface of the polymeric sheet to enhance contact between said upward facing surface of the substrate layer and the downward facing surface of the polymeric sheet with the water based, polymeric adhesive therebetween; and allowing the water based, polymeric adhesive to dry, thereby adhering the polymeric sheet to the upward facing surface of the underlying substrate layer.

19. The method of claim 18 wherein said water based, polymeric adhesive further comprises about 50 weight percent polyisoprene latex, about 25 weight percent polyvinyl alcohol/vinyl acetate, about 15 weight percent deionized water, about 8 weight percent aluminum silicate, and less than about one weight percent each of methanol, acrylic acid polymer, and sodium hydroxide.

* * * * *